US006685399B2

(12) United States Patent
Iemura et al.

(10) Patent No.: US 6,685,399 B2
(45) Date of Patent: Feb. 3, 2004

(54) HIGH-ASEISMIC REINFORCED CONCRETE PIER USING UNBONDED HIGH-STRENGTH CORE MEMBER

(75) Inventors: Hirokazu Iemura, Kyoto (JP); Yoshikazu Takahashi, Kyoto (JP)

(73) Assignee: Kyoto University, Kyoto (JP)

( * ) Notice: Subject to any disclaimer, the term of this patent is extended or adjusted under 35 U.S.C. 154(b) by 0 days.

(21) Appl. No.: 09/817,852

(22) Filed: Mar. 26, 2001

(65) Prior Publication Data

US 2001/0046417 A1 Nov. 29, 2001

(30) Foreign Application Priority Data

Apr. 11, 2000 (JP) ..... 2000-109788

(51) Int. Cl.[7] ..... E02D 5/10

(52) U.S. Cl. ..... 405/256; 405/231; 52/294; 52/295; 52/169.9

(58) Field of Search ..... 405/256, 257, 405/250, 251, 252, 238, 231; 52/294, 295, 169.9, 223.7, 806, 218

(56) References Cited

U.S. PATENT DOCUMENTS 2,187,313 A * 1/1940 Greulich ..... 405/256
4,317,643 A * 3/1982 Miller ..... 405/256
4,627,769 A * 12/1986 Lee ..... 405/256
4,918,891 A * 4/1990 Gerszewski ..... 52/295
5,660,007 A * 8/1997 Hu et al. ..... 52/295
5,788,419 A * 8/1998 Whitty et al. ..... 405/256
5,934,835 A * 8/1999 Whitty et al. ..... 405/256

FOREIGN PATENT DOCUMENTS

JP 9-100536 * 4/1997
JP 10-252018 * 9/1998
JP 2000-017615 1/2000

* cited by examiner

*Primary Examiner*—Frederick L. Lagman
(74) *Attorney, Agent, or Firm*—Knobbe Martens Olson & Bear, LLP

(57) ABSTRACT

A reinforcing concrete pier comprising a concrete member 1*a*, and structural main reinforcing bars 1*b* embedded in the concrete member so as to extend along an axial direction of the concrete member. A high-strength core member 2, which is higher in strength than the structural main reinforcing bars, is embedded in the concrete member inside the structural main reinforcing bars so as to extend along the axial direction. One end portion 2*b* with a gap of the core member is fixed to the concrete member at a base portion of the pier, and the other end portion 2*a* of the core member is fixed to the concrete member at an intermediate portion 1*d* of the pier. Further, the core member has an unbounded region D in which the core member is not bonded to the concrete member between the one end portion and the other end portion.

7 Claims, 5 Drawing Sheets

FIG. 7a

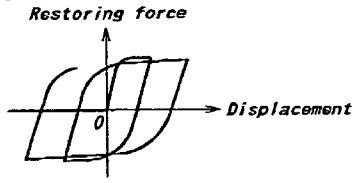

Restoring force characterristic of RC pier portion 1

Rigidity in plastic region is extremely low, and then residual displacement caused after large earthquake is large

FIG. 7d

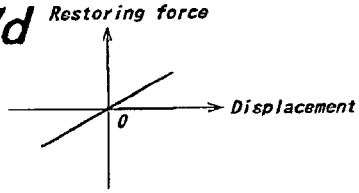

Restoring force characteristic of high-strength core member 2 (Without gap)

FIG. 7b

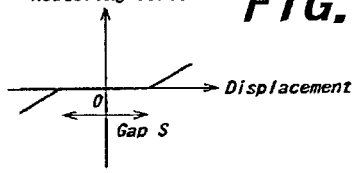

Restoring force characteristic of high-strength core member 2 (With gap)

FIG. 7e

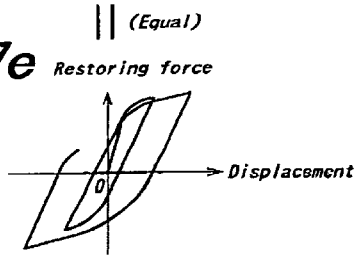

Elastic restoring force makes residual deformation small

Energy absorbing amount is same as is the case with only RC pier portion 1 when displacement is same

FIG. 7c

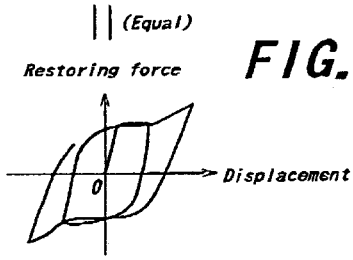

Same as hysterisis of RC pier portion 1 when displacement is smaller than gap

Elastic restoring makes residual deforamtion small when gap is closed

HIGH-ASEISMIC REINFORCED CONCRETE PIER USING UNBONDED HIGH-STRENGTH CORE MEMBER

BACKGROUND OF THE INVENTION

1. Field of the Invention

The present invention relates to a high-aseismic RC (reinforced concrete) pier.

2. Description of the Related Art

There are conventionally known, for example, PC (prestressed concrete) piers as high-aseismic piers. The PC piers are subjected to prestresses to increase strength and rigidity of the piers, thereby reducing a residual plastic deformation after strong earthquakes. However, the PC piers have disadvantages in that the prestresses increase permanent stresses in the concrete, thereby making a maximum strength-relevant deformation, caused when the concrete is collapsed, less than that of usual RC piers, with decrease of the deformation characteristic.

On the other hand, there are known RC members mixedly using reinforcing bars of a variety of strengths. The object of these RC members resides in that using reinforcing bars of different yield strengths and yielding their reinforcing bars in turn provides secondary rigidity to the load-deformation relationship. However, when the deformation is large, all the reinforcing bars yield, thereby disabling an elastic restoring force to be obtained, which makes it difficult to decrease the residual plastic deformation.

A general aseismic design is carried out in two steps; the first step is to carry out a strength design for an earthquake of level I which is relatively high in frequency, and the second step is to carry out a horizontal strength check of evaluating the deformation characteristic, including a plastic zone of the member, for an earthquake of level to which is low in frequency, but very strong. Also, the above aseismic design requests that the residual deformation ranges within the specified ratio (1/100 in Japan) of the height of the pier in order to make repairs in its relatively early steps after the large earthquake. That is, the piers having a large earthquake-resistance are ones having both of high strength for the earthquake of level I and of large toughness and a small residual deformation for the earthquake of level II. In particular, however, the requirement items of the large toughness and the small residual deformation for the earthquake of level II are contradictory to each other, which makes it difficult for the conventional RC piers to unite them.

It is therefore an object of the invention to provide a pier which is capable of advantageously solving the above-mentioned problems.

SUMMARY OF THE INVENTION

The present invention provides a reinforcing concrete pier comprising a concrete member, and structural main reinforcing bars embedded in the concrete member so as to extend along an axial direction of the concrete member, characterized in that a high-strength core member, which is higher in strength than the structural main reinforcing bars, is embedded in the concrete member inside the structural main reinforcing bars so as to extend along the axial direction; one end portion of the core member is fixed to the concrete member at a base portion of the pier, and the other end portion of the core member is fixed to the concrete member at an intermediate portion of the pier; and the core member has an unbounded region in which the core member is not bonded to the concrete member between the one end portion and the other end portion.

According to the reinforced concrete pier of the invention, the core member is made of material higher in strength than the structural main reinforcing bar in such a manner that the core member takes an elastic behavior when the pier is deformed largely, and arranged inside the structural main reinforcing bars, and the unbonded region is provided between the base portion and the intermediate portion, thereby causing the core member to be equalized in stress all over the total length of the core member. The high-strength core member surely raises secondary rigidity in a plastic region of the deformation-restoring force of the pier, and increases the final deformation characteristic corresponding to the yield strength.

Accordingly, according to the reinforced concrete pier of the invention, the secondary rigidity in the plastic region of the deformation-restoring force of the pier is improved, and the deformation characteristic increases up to the deformation corresponding to the yield strength, thereby resulting in reasonable (economical) improvement of the aseismic design for the earthquake of level II, and simultaneously the yield strength is increased, thereby resulting in improvement of the aseismic design for the earthquake of level I. And also, the high-strength core member is not subjected to prestresses, thereby making the construction work much easier compared to the PC pier.

Moreover, in this embodiment, it is preferred that at least one end portion of the core member has an axial direction-wise gap, a magnitude of which sets a deformation amount of the pier at which the core member starts resisting against a tensile force.

According to this construction, the deformation amount of the pier in which the core member stars resisting against the tensile force and then the secondary rigidity occurs can be set in a desired manner by adjusting a magnitude of the axial direction-wise gap, thereby enabling the core member to act on a deformed region of the pier in which the pier is deformed largely, which makes the final deformation corresponding to the yield strength large.

Further object and advantages of the invention will be apparent from the following description of the preferred embodiments of the invention as illustrated in the accompanying drawings.

BRIEF DESCRIPTION OF THE DRAWINGS

FIGS. 5*a* and 5*b* are views useful in explaining that core members disposed in an unbonded region are equalized in strain in the pier according to one embodiment of the invention, in which FIG. 5*a* shows an usual RC pier, whereas FIG. 5*b* shows an RC pier with built-in unbonded core members;

FIG. 7 is a view useful in explaining that a pier having unbonded high-strength core members is reduced in residual deformation in the pier according to the embodiment of the invention.

DETAILED DESCRIPTION OF THE PREFERRED EMBODIMENTS

The inventions will now be described in detail with reference to the drawings showing one embodiment.

Figure 1:
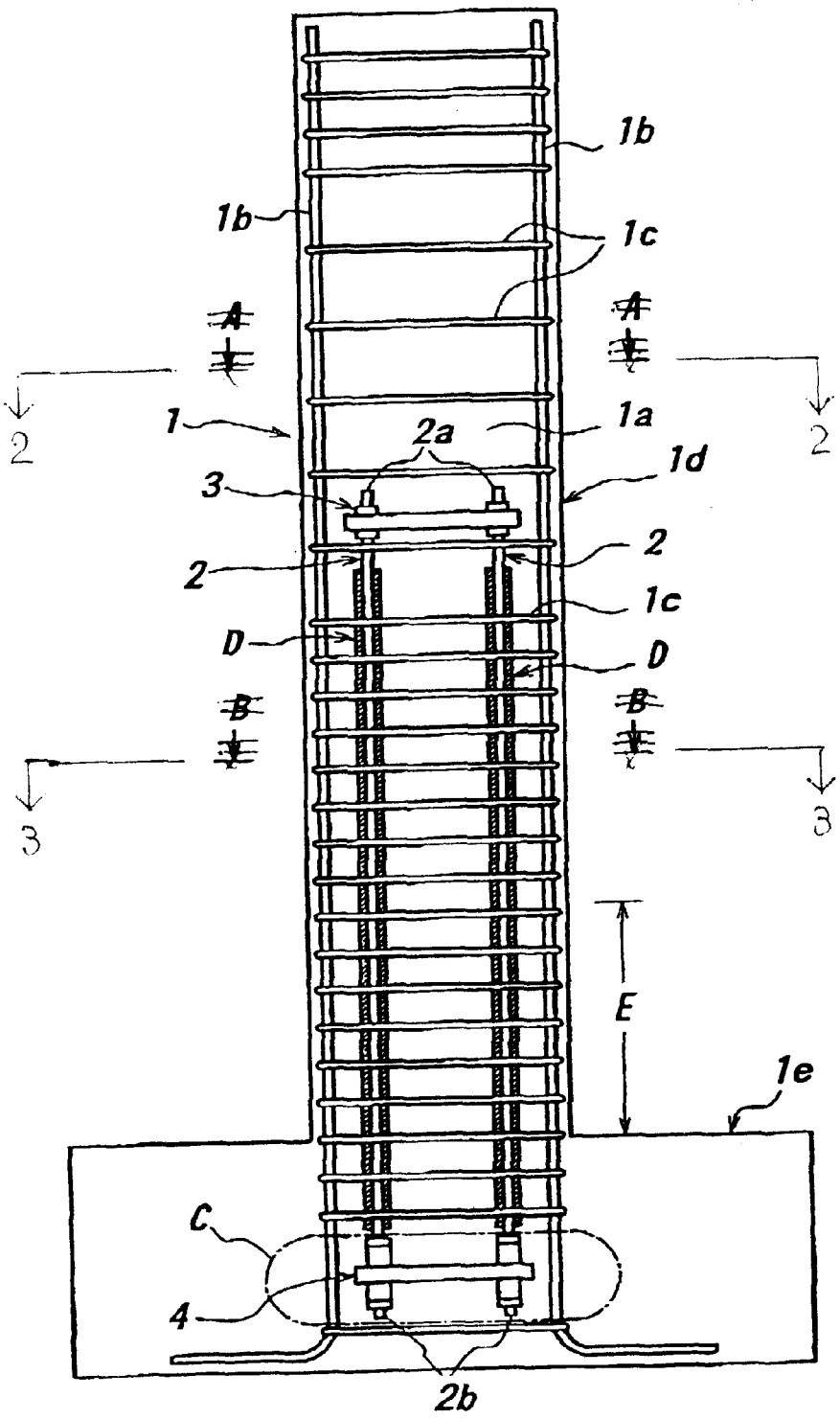
FIG. 1 is a constructional view schematically showing a high-aseismic RC pier according to one embodiment of the present invention.
Figure 2:
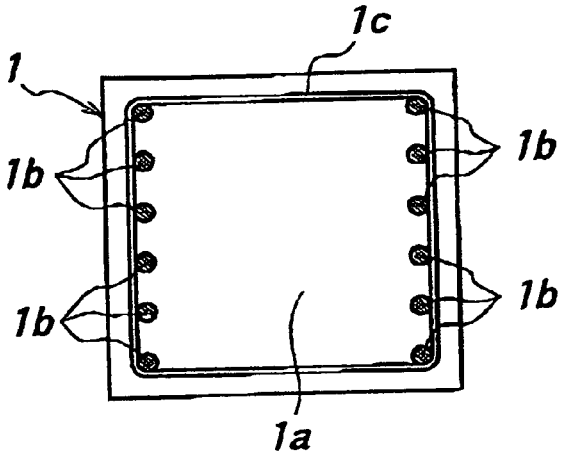
FIG. 2 is a sectional view taken on line 2—2 of FIG. 1.
Figure 3:
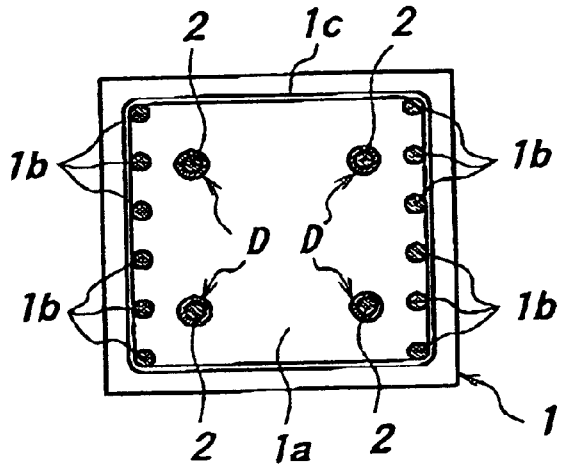
FIG. 3 is a sectional view taken on line 3—3 of FIG. 1.
Figure 4:
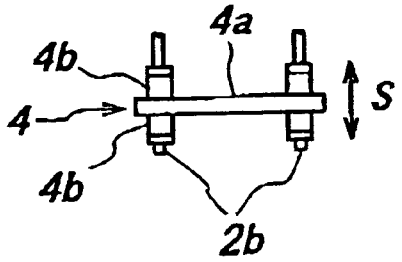
FIG. 4 is a view useful in explaining a portion C in FIG. 1.

FIG. 1 is a constructional view schematically showing a high-aseismic RC pier according to one embodiment of the present invention, FIG. 2 is a sectional view taken on line 2—2 of FIG. 1, FIG. 3 is a sectional view taken on line 3—3 of FIG. 1, FIG. 4 is a view useful in explaining a portion C in FIG. 1.

Like a conventional usual RC pier, a reinforced concrete (RC) pier according to one embodiment of the invention comprises, as shown in a sectional view of FIG. 2, an RC pier portion 1 having, at an upper portion thereof, a concrete member 1*a*, a structural main reinforcing bars 1*b* embedded in an surface portion of the concrete member 1*a* so as to extend along an axial direction of the concrete member 1*a*, and horizontal bonded reinforcing bars 1*c* embedded in the concrete member 1*a* so as to extend perpendicularly to the axial direction of the concrete member 1*a* and surrounding the structural main reinforcing bars 1*b*, and also comprises, as shown in a sectional view of FIG. 3, high-strength core members 2 embedded between a base portion 1*d* and an intermediate portion 1*e* of the RC pier portion 1 inside the structural main reinforcing bars 1*b* so as to extend along the axial direction of the concrete member 1*a* of the RC pier portion 1.

Moreover, in this embodiment, the core members 2 comprise, for example, high strength reinforcing bars, or made of new material of aramid fibers, or the like which is higher in strength than the structural main reinforcing bar 1*b*, in order for the structural main reinforcing bar 1*b* to take an elastic behavior in a plastic region.

In this embodiment, disposed between the base member 1*d* and the intermediate portion 1*e* is, as shown in FIG. 3, an unbonded region D in which the high-strength core member 2 and the concrete member 1*a* are not bonded to each other; however, a gap between the core member 2 and the concrete member 1*a* is made less in such a manner that the core member 2 bears a compression force in the unbonded region D.

An upper end portion 2*a* of the high-strength core member 2 is fixed to the concrete member 1*a* inside the intermediate portion 1*d* of the RC pier portion 1 by a fixing portion 3 of a usual construction. The intermediate portion 1*d* including the fixing portion 3 is located in such a manner that the core member 2 includes the unbonded region D as a plastic hinge region of the RC pier portion 1 within the total length thereof and that the core member 2 has a length as to behave elastically without yielding even in a large deformation region of the pier.

On the other band, a lower end portion 2*b* of the core member 2 of high strength is fixed to the concrete member 1*a* at the base portion 1*e* of the RC pier portion 1 by a fixing portion 4. However, in this fixing portion 4 of this embodiment, a cushion portion 4*b* is interposed between the core member 2 and the fixing plate 4*a* in the axial direction of the core member 2, thereby substantially providing a gap S, which results in adjustment of a deformation amount of the RC pier portion 1 when the core member 2 start resisting the tensile force. This results in substantially elastic behavior of the core member 2 in a largely deformed region of the pier of the embodiment.

Figure 5A:
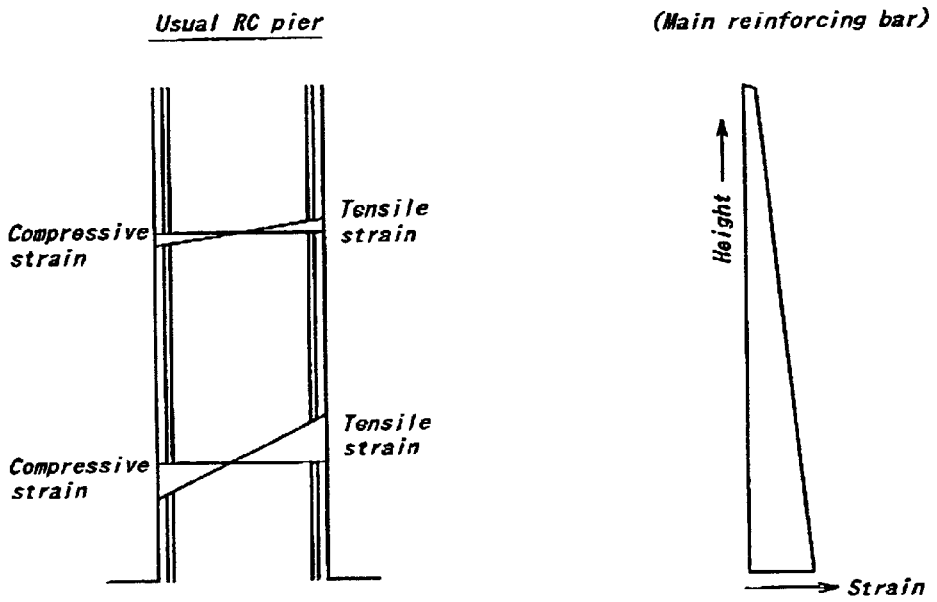
Figure 5B:
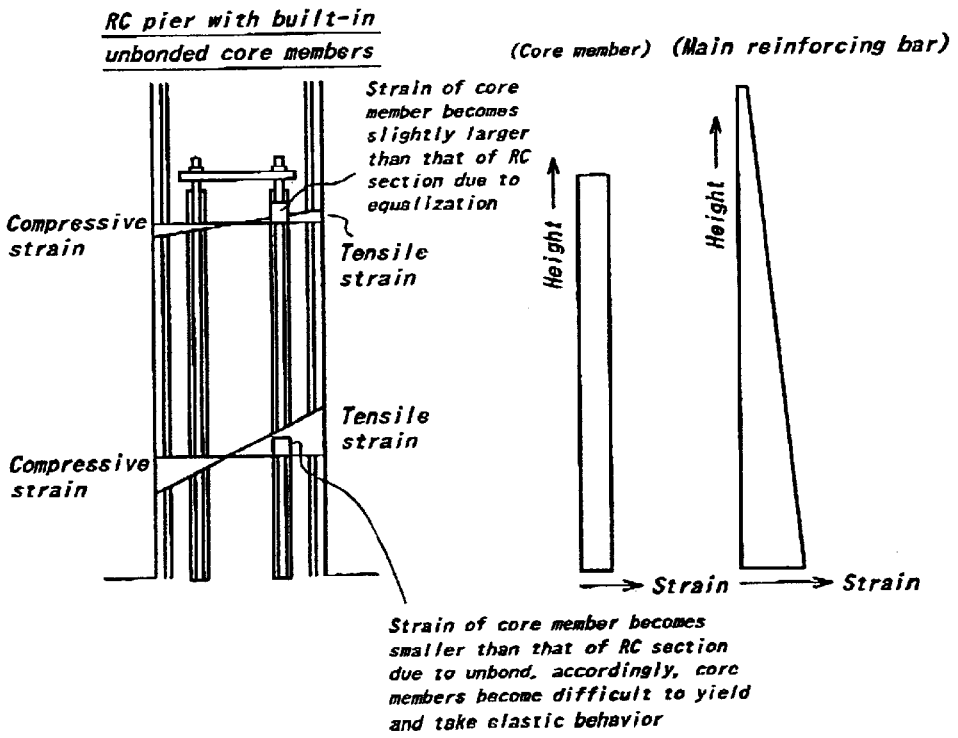

Effective exhibition of the function of the RC pier according to the embodiment requires that the high-strength core member 2 takes an elastic behavior even when the pier is deformed largely. For this end, as described above, the core member 2 is made of material higher in strength than the structural main reinforcing bar 1*b*, and arranged inside the structural main reinforcing bars 1*b*, and the unbonded region D for separating the core member 2 and the concrete member 1*a* is provided, thereby causing the core member 2 to be equalized in stress all over the total length of the core member 2, as shown in FIG. 5. Further, arranging the gap S at least one of the fixing portions, namely, the fixing portion 4 in this embodiment enlarges a deformed region of the core member 2.

Figure 6A:
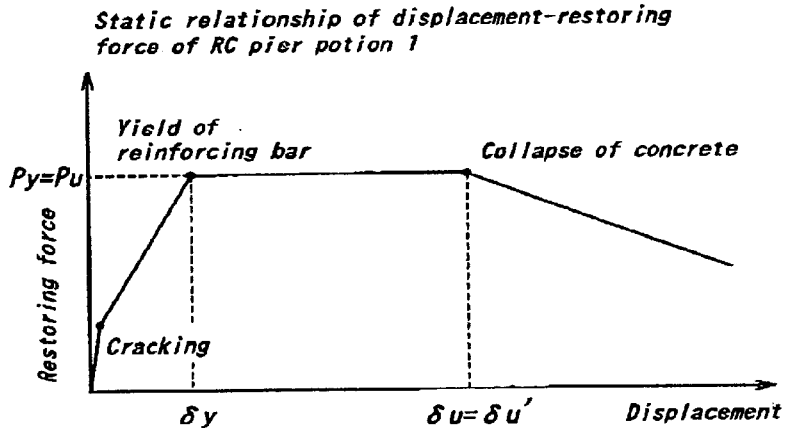
FIG. 6 is a view useful in explaining that a pier having unbonded high-strength core members is improved in static characteristic in the pier according to the embodiment of the invention.
Figure 6B:
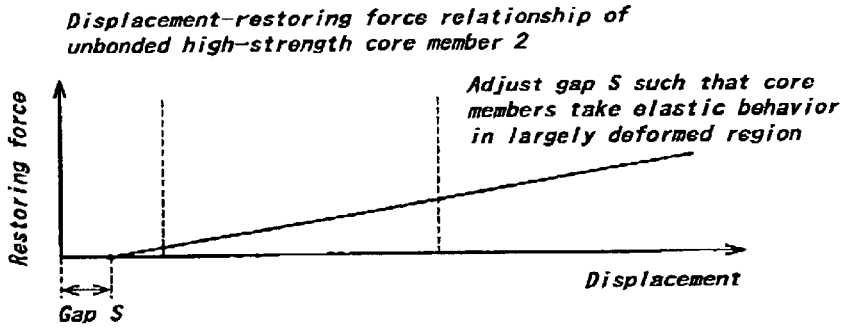
Figure 6C:
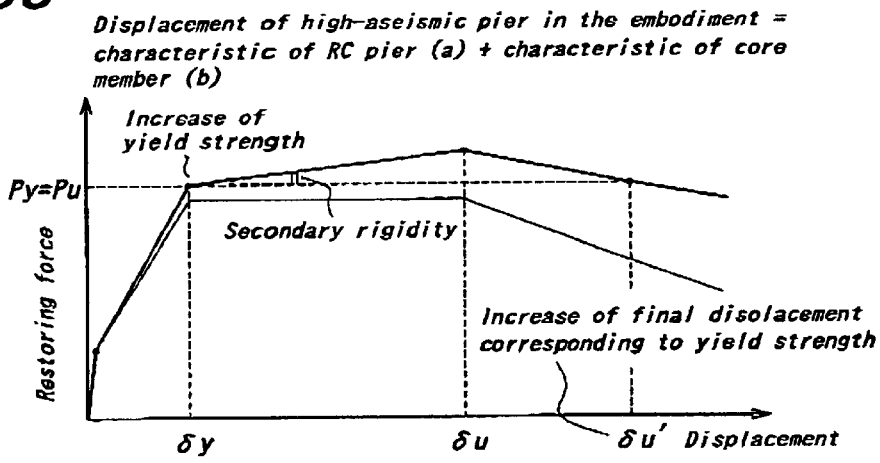

According to thus constructed embodiment, the deformation-restoring force relationship of the RC pier portion 1 shown in FIG. 6*a* is added with the elastic deformation-restoring force relationship shown in FIG. 6*b*, thereby enabling positive secondary rigidity to be applied to plastic region of the deformation-restoring force relationship of the RC pier. This increases the deformation characteristic and reduces the residual deformation.

Moreover, FIGS. 7*a* to 7*c* show a principle that the construction according to this embodiment reduces the residual deformation. That is, the use of only the RC pier portion 1 having an usual reinforced concrete construction makes the rigidity in the plastic region extremely low as shown in FIG. 6*a*, which increases the residual deformation after the large earthquake as shown in FIG. 7*a*. However, by additionally arranging the high-strength core members 2 in the unbonded region D and the gap (dead zone) S provides the same hysterisis as is the case with only the RC pier portion 1 when the deformation amount is smaller than the gap S, whereas the core member 2 is subjected to an elastic restoring force to make the residual deformation smaller than that obtained by only the RC pier portion 1 when the deformation amount is so large as to shut the gap S.

As described above, the invention is described based on the illustrated embodiment, but the invention is not limited thereto. For example, the fixing portion substantially having the gap by interposing the cushion member between the core member and the fixing plate may be disposed on the upper end portion of the core member, or both end portions of the core member. Further, the gap may not be disposed on the fixing portion of any one of the end portions of the core member. On this occasion, the core member immediately acts on the deformation of the pier as shown in FIG. 7*d*, thereby making the residual deformation small as shown in FIG. 7*c*. But, the energy absorbing amount caused at the time of deformation becomes the same as is the case with only the RC pier portion 1.

In the deformation-restoring force relationship of a general reinforced concrete pier, the rigidity exhibited after the yield is almost zero, a large non-linear response is shown at the large earthquake, and the residual deformation is large. On the other band, according to the reinforced concrete of the invention, the unbonded region is provided in the usual RC pier in which the high-strength core members which take an elastic behavior when the deformation is large are added to provide the rigidity, thereby enabling the positive secondary rigidity to be obtained, which increases the final deformation corresponding to the yield strength. Also, adding the positive rigidity enables response to the earthquake to be stabilized, and decreases the residual plastic deformation.

Further, according to the reinforced concrete pier of the present invention, it is possible to make the construction work much easier compared with the PC pier.

Many widely different embodiments of the invention may be constructed without departing from the spirit and scope of the invention. It should be understood that the invention is not limited to the specific embodiments described in the specification, except as defined in the appended claims.

What is claimed is:

1. A reinforcing concrete pier comprising a concrete member, and structural main reinforcing bars embedded in said concrete member so as to extend along an axial direction of said concrete member, characterized in that a high-strength core member, which is higher in strength than said structural main reinforcing bars, is enclosed in said concrete member and surrounded by said structural main reinforcing bars so as to extend along said axial direction;

one end portion of said core member is embedded in and fixed to said concrete member at a base portion of said pier, and the other end portion of said core member is embedded in and fixed to said concrete member at an intermediate portion of said pier; and said core member has an unbounded region in which said core member is not bonded to said concrete member between said one end portion and said other end portion.

2. A reinforcing concrete pier according to claim 1, characterized in that at least one end portion of said core member has an axial direction-wise gap, a magnitude of which sets a deformation amount of said pier at which said core member starts resisting against a tensile force.

3. A reinforcing concrete pier comprising:

a concrete member shaped in a pier, said concrete member having a base portion;

structural main reinforcing bars embedded in said concrete member, said bars extending in the concrete member in its axial direction; and at least one high-strength core member enclosed in said concrete member and surrounded by the structural main reinforcing bars, said core member extending from the base portion to an intermediate portion of the pier in its axial direction, wherein the core member has (i) two end portions embedded in and fixed to the concrete member, and (ii) an unbounded region in which the core member is not bonded to the concrete member between the two end portions.

4. The reinforcing concrete pier according to claim 3, wherein the end portion of the core member in the base portion has the axial direction-wise gap, and the end portion of the core member in the intermediate portion has no axial direction-wise gap.

5. The reinforcing concrete pier according to claim 3, wherein at least two core members are enclosed in the concrete member.

6. The reinforcing concrete pier according to claim 3, further comprising a fixing plate fixed in the concrete member and provided at each end portion of the core member, wherein each end portion of the core member is connected to the fixing plate.

7. The reinforcing concrete pier according to claim 6, wherein at least one of the end portions of the core member further comprises a cushion member, wherein the.end portion is connected to the fixing plate via the cushion member to form an axial direction-wise gap, a magnitude of which sets a deformation amount of the pier at which the core member starts resisting against a tensile force.

* * * * *